US005393478A

United States Patent [19]

Sen et al.

[11] Patent Number: 5,393,478

[45] Date of Patent: Feb. 28, 1995

[54] PROCESS FOR COAGULATION AND WASHING OF POLYBENZAZOLE FIBERS

[75] Inventors: Ashish Sen, Midland, Mich.; Katsuya Tani, Shiga; Kazunori Katoh, Ohtsu, both of Japan

[73] Assignee: The Dow Chemical Company, Midland, Mich.

[21] Appl. No.: 110,149

[22] Filed: Aug. 20, 1993

[51] Int. Cl.[6] ..... D01F 6/00

[52] U.S. Cl. ..... 264/203; 264/331.11; 264/341; 264/343; 264/344; 264/345; 528/293

[58] Field of Search ..... 264/203, 341, 343, 344, 264/345, 331.11; 528/293

[56] References Cited

U.S. PATENT DOCUMENTS

| | | | |
|---|---|---|---|
| 3,760,054 | 9/1973 | Moulds | 264/49 |
| 4,263,245 | 4/1981 | Tan | 264/184 |
| 4,377,546 | 3/1983 | Helminiak et al. | 264/232 |
| 4,487,735 | 12/1984 | Chenevey et al. | 264/85 |
| 4,533,693 | 8/1985 | Wolfe et al. | 524/417 |
| 4,581,437 | 4/1986 | Mammone | 528/183 |
| 4,606,875 | 8/1986 | Chenevey et al. | 264/85 |
| 4,772,678 | 9/1988 | Sybert et al. | 528/179 |
| 4,845,150 | 7/1989 | Kovak et al. | 524/602 |
| 4,876,077 | 10/1989 | Murakami | 423/448 |
| 4,915,984 | 4/1990 | Murakami | 427/113 |
| 4,973,442 | 11/1990 | Harvey et al. | 264/503 |
| 4,977,223 | 12/1990 | Arnold et al. | 525/432 |
| 4,985,193 | 1/1991 | Allen | 264/184 |
| 5,288,445 | 2/1994 | Tani et al. | 264/85 |
| 5,288,452 | 2/1994 | Yabuki | 264/345 |
| 5,292,469 | 3/1994 | Bowman et al. | 264/169 |
| 5,292,470 | 3/1994 | Reddy et al. | 264/169 |

FOREIGN PATENT DOCUMENTS

| | | |
|---|---|---|
| 63-28530 | 2/1986 | Japan . |
| 62-53339 | 3/1987 | Japan . |
| 63-253339 | 3/1987 | Japan . |
| 63-74612 | 4/1988 | Japan . |
| 63-210138 | 8/1988 | Japan . |
| 284509 | 3/1990 | Japan . |
| 1393011 | 4/1972 | United Kingdom . |

OTHER PUBLICATIONS

Chemical Abstract 111: 196226f (p. 59).

W. W. Adams et al., AFWAL-TR-864011, *Processing, Properties, Structure, and Morphology of PBO and ABPBO Polymer Fibers*, Aug. 1986.

*Primary Examiner*—John Kight, III

*Assistant Examiner*—Terressa Mosley

[57] ABSTRACT

Fibers spun from polybenzazole dopes can quickly be washed to remove polyphosphoric acid by a combination of initially washing with an acidic liquid and second washing with a hot leaching fluid at at least about 60. The process can reach acceptable residual phosphorous levels (1500–2000 ppm) in as little as about 2 or 3 minutes.

17 Claims, No Drawings

PROCESS FOR COAGULATION AND WASHING OF POLYBENZAZOLE FIBERS

BACKGROUND OF THE INVENTION

This application relates to the art of making polybenzazole fibers.

It is well known to polymerize polybenzazole polymers in polyphosphoric acid solutions, so that an acid dope is formed. The resulting dopes are spun and drawn to make fibers. The dope fibers are coagulated by contact with a liquid that dilutes the solvent, and the residual acid is washed from the fibers. See, e.g., Wolfe et al., U.S. Pat. No. 4,533,693 (Aug. 5, 1985) which is incorporated herein by reference.

The coagulation and leaching steps can become a significant bottleneck in a continuous production process, because they are very time-consuming. Commercially desirable fibers should contain no more than about 2000–5000 ppm phosphorus, and lower levels may be useful for some purposes. (Residual solvent acid is usually expressed in terms of parts-per-million (ppm) of residual phosphorus in the fiber, because common tests measure the quantity of phosphorus in the fiber. The quantity of residual acid can easily be calculated from the residual phosphorus.)

On the other hand, long leaching times are unacceptable in commercial production, because the fiber is spun at a very rapid rate and needs to be washed at an equally rapid rate.

What is needed is an accelerated process to coagulate and leach polybenzazole fiber.

SUMMARY OF THE INVENTION

The present invention is a process to coagulate and wash a polybenzazole dope fiber, which contains polybenzazole polymer and polyphosphoric acid, comprising the steps of:

(1) contacting the dope fiber with an acidic liquid coagulant, (2) optionally contacting the fiber with a second liquid having a pH higher than the acidic liquid coagulant, and (3) contacting the fiber with a hot leaching fluid, that is capable of removing residual phosphorous compounds, at a temperature of at least about 60° C., for a combined residence time in steps (1), (2) and (3) of no more than about 10 minutes, whereby a polybenzazole fiber containing no more than about 5000 ppm phosphorus is formed.

The process of this invention makes fibers with low phosphorus content in a relatively short time. The fibers are useful in ropes, cables, composites and protective garments.

DETAILED DESCRIPTION OF THE INVENTION

The present invention uses polybenzoxazole (PBO) or polybenzothiazole (PBT) polymers or copolymers that are polymerized in a mixture containing polyphosphoric acid. PBO, PBT and random, sequential and block copolymers of PBO and PBT are described in references such as Wolfe et al., *Liquid Crystalline Polymer Compositions, Process and Products,* U.S. Pat. No. 4,703,103 (Oct. 27, 1987); Wolfe et al., *Liquid Crystalline Poly(2,6-Benzothiazole) Compositions, Process and Products,* U.S. Pat. No. 4,533,724 (Aug. 6, 1985); Wolfe, *Liquid Crystalline Polymer Compositions, Process and Products,* U.S. Pat. No. 4,533,693 (Aug. 6, 1985); Evers, *Thermo-oxadatively Stable Articulated p-Benzobisoxazole and p-Benzobisthiazole Polymers,* U.S. Pat. No. 4,359,567 (Nov. 16, 1982); Tsai et al., *Method for Making Heterocyclic Block Copolymer,* U.S. Pat. No. 4,578,432 (Mar. 25, 1986); 11 Ency. Poly. Sci. & Eng., *Polybenzothiazoles and Polybenzoxazoles,* 601 (J. Wiley & Sons 1988) and W. W. Adams et al., *The Materials Science and Engineering of Rigid-Rod Polymers* (Materials Research Society 1989), which are incorporated herein by reference.

The polymer may contain AB-mer units, as represented in Formula 1(a), and/or AA/BB-mer units, as represented in Formula 1(b)

1(a)

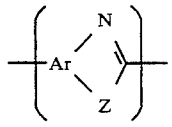

AB

1(b)

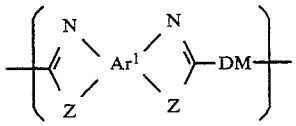

AA/BB wherein:

Each Ar represents an aromatic group. The aromatic group may be heterocyclic, such as a pyridinylene group, but it is preferably carbocyclic. The aromatic group may be a fused or unfused polycyclic system, but is preferably a single six-membered ring. Size is not critical, but the aromatic group preferably contains no more than about 18 carbon atoms, more preferably no more than about 12 carbon atoms and most preferably no more than about 6 carbon atoms. Examples of suitable aromatic groups include phenylene moieties, tolylene moieties, biphenylene moieties and bis-phenylene ether moieties. $Ar^1$ in AA/BB-mer units is preferably a 1,2,4,5-phenylene moiety or an analog thereof. Ar in AB-mer units is preferably a 1,3,4-phenylene moiety or an analog thereof.

Each Z is independently an oxygen or a sulfur atom.

Each DM is independently a bond or a divalent organic moiety that does not interfere with the synthesis, fabrication or use of the polymer. The divalent organic moiety may contain an aliphatic group, which preferably has no more than about 12 carbon atoms, but the divalent organic moiety is preferably an aromatic group (Ar) as previously described. It is most preferably a 1,4-phenylene moiety or an analog thereof.

The nitrogen atom and the Z moiety in each azole ring are bonded to adjacent carbon atoms in the aromatic group, such that a five-membered azole ring fused with the aromatic group is formed.

The azole rings in AA/BB-mer units may be in cis- or trans-position with respect to each other, as illustrated in 11Ency. Poly. Sci. & Eng., supra, at 602, which is incorporated herein by reference.

The polymer preferably consists essentially of either AB-PBZ mer units or AA/BB-PBZ mer units, and more preferably consists essentially of AA/BB-PBZ mer units. The polybenzazole polymer may be rigid rod, semi-rigid rod or flexible coil. It is preferably a lyotropic liquid-crystalline polymer, which forms liquid crystalline domains in solution when its concentration exceeds a "critical concentration point." It is preferably rigid rod in the case of an AA/BB-PBZ polymer or semi-rigid in the case of an AB-PBZ polymer. Azole rings within the polymer are preferably oxazole rings (Z=0). Preferred mer units are illustrated in Formulae 2(a)–(h). The polymer more preferably consists essentially of mer units selected from those illustrated in 2(a)–(h), and most preferably consists essentially of a number of identical units selected from those illustrated in 2(a)–(d).

(a)

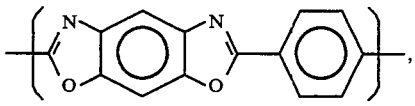

(b)

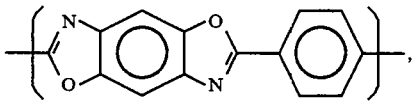

(c)

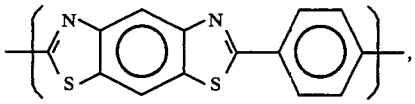

(d)

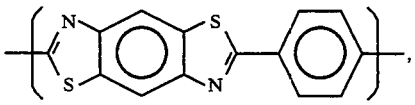

(e)

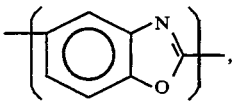

(f)

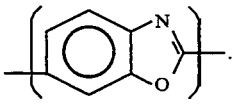

(g)

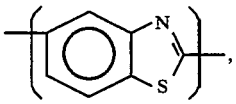

and (h)

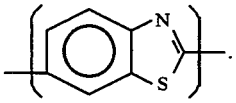

Each polymer preferably contains on average at least about 25 mer units, more preferably at least about 50 mer units and most preferably at least about 100 mer units. The intrinsic viscosity of rigid AA/BB-PBZ polymers in methanesulfonic acid at 25° C. is preferably at least about 10 dL/g, more preferably at least about 15 dL/g and most preferably at least about 20 dL/g. For some purposes, an intrinsic viscosity of at least about 25 dL/g or 30 dL/g may be best. Intrinsic viscosity of 60 dL/g or higher is possible, but the intrinsic viscosity is preferably no more than about 50 dL/g. The intrinsic viscosity of semi-rigid AB-PBZ polymers is preferably at least about 5 dL/g, more preferably at least about 10 dL/g and most preferably at least about 15 dL/g.

The dope should contain a high enough concentration of polymer for the polymer to coagulate to form an acceptable fiber. When the polymer is lyotropic liquid-crystalline, then the concentration of polymer in the dope is preferably high enough to provide a liquid-crystalline dope. The concentration of the polymer is preferably at least about 7 weight percent, more preferably at least about 10 weight percent and most preferably at least about 14 weight percent. The maximum concentration is limited primarily by practical factors, such as polymer solubility and dope viscosity. The concentration of polymer is seldom more than 30 weight percent, and usually no more than about 20 weight percent.

Suitable polymers or copolymers and dopes can be synthesized by known procedures, such as those described in Wolfe et al., U.S. Pat. No. 4,533,693 (Aug. 6, 1985); Sybert et al., U.S. Pat. No. 4,772,678 (Sep. 20, 1988); Harris, U.S. Pat. No. 4,847,350 (Jul. 11, 1989); and Gregory et al., U.S. Pat. No. 5,089,591 (Feb. 18, 1992), which are incorporated herein by reference. In summary, suitable monomers (AA-monomers and BB-monomers or AB-monomers) are reacted in a solution of nonoxidizing and dehydrating acid under nonoxidizing atmosphere with vigorous mixing and high shear at a temperature that is increased in step-wise or ramped fashion from no more than about 120° C. to at least about 190° C. Examples of suitable AA-monomers include terephthalic acid and analogs thereof. Examples of suitable BB-monomers include 4,6-diaminoresorcinol, 2,5-diaminohydroquinone, 2,5-diamino-1,4-dithiobenzene and analogs thereof, typically stored as acid salts. Examples of suitable AB-monomers include 3-amino-4-hydroxybenzoic acid, 3-hydroxy-4-aminobenzoic acid, 3-amino-4-thiobenzoic acid, 3-thio-4-aminobenzoic acid and analogs thereof, typically stored as acid salts.

The dope is formed into a fiber—usually by extruding through a spinneret and drawing across a gap. Suitable processes are described in the references previously incorporated and in Chau et al., Ser. No. 07/985,079 (filed Dec. 3, 1992), which is incorporated herein by reference. The spinneret preferably contains a plurality of holes. The number of holes in the spinneret and their arrangement is not critical to the invention, but it is desirable to maximize the number of holes for economic reasons. The spinneret may contain as many as 100 or 1000 or more, and they may be arranged in circles or in grids or in any other desired arrangement. The spinneret may be constructed out of ordinary materials that will not be degraded by the dope, such as stainless steel.

Dope exiting the spinneret enters a gap between the spinneret and the coagulation zone. The gap is typically called an "air gap" although it need not contain air. The gap may contain any fluid that does not induce coagulation or react adversely with the dope, such as airy nitrogen, argon, helium or carbon dioxide. The dope is preferably drawn to a spin-draw ratio of at least about 20, highly preferably at least about 40, more preferably at least about 50 and most preferably at least about 60. The spin-draw ratio is defined in this application as the ratio between the take-up velocity of the filaments and the capillary velocity ($v_c$) of the dope in the spinneret. The draw should be sufficient to provide a fiber having the desired diameter per filament, as described hereinafter. To spin low diameter filaments using large holes, very high spin-draw ratios (such as 75, 100, 150 or 200 or more) may be desirable.

The fiber is coagulated and residual solvent is leached out by a multi-step process. (The term "coagulation" is commonly used in the art to describe the step in which dope is initially contacted with a fluid that precipitates the polymer from solution and removes part of the solvent. The term "leaching" is commonly used in the art to describe the step of subsequently washing almost all of the residual solvent from the coagulated polymer. The term "coagulation" does not necessarily imply that the dope is a flowing liquid and changes into a solid phase. The dope may be at a temperature low enough so that it is essentially non-flowing before the coagulation step begins.)

In the first (coagulation) step, the fiber is contacted with a acidic liquid coagulant. The acidic liquid coagulant is preferably an aqueous acid solution and more preferably an aqueous phosphoric acid solution. The solution preferably contains at least about 10 weight percent acid, more preferably at least about 20 weight percent acid, and most preferably at least about 30 weight percent acid. It preferably contains no more than about 50 weight percent acid, and more preferably no more than about 40 weight percent acid. The first acidic solution may be at any temperature at which it is liquid (usually about −5° C.–100° C.). Its temperature is preferably at least about 5° C. to 10° C. Its temperature is preferably no more than about 50° C. and more preferably no more than about 30° C. The residence time is preferably no more than about 5 minutes, more preferably no more than about 1 minutes, more highly preferably no more than about 30 seconds and most preferably no more than about 10 seconds. Coagulation occurs very quickly, and so long times are usually unnecessary. In most cases, residence time in the coagulation bath will be at least about 0.05 seconds or 0.1 second.

The acidic liquid coagulant may be applied in any manner usual for washing fibers, such as by immersing or spraying. It is preferably circulated to prevent the acid content from exceeding the desirable level.

It is important that the surface of the fiber should not be allowed to dry after the coagulation step starts and before the leaching step is completed. It is theorized, without intending to be bound, that the wet never-dried surface of the fiber is relatively porous and provides paths to wash residual phosphorus from inside the fiber. On the other hand, it is theorized that the pores close when they become dry and do not open even when they become wet again. The closed pores trap residual phosphorus inside the fiber.

Optionally, the coagulated fiber may be contacted with one or more washing liquids, which contain less acid than the acidic liquid coagulant, prior to the hot leaching step. The washing liquid preferably contains no more than about 25 weight percent acid, more preferably no more than about 20 weight percent and most preferably no more than about 10 weight percent. The washing liquid may optionally contain a base, such as dilute alkali metal hydroxide, instead of an acid. In all other respects, the washing step has the same description and preferred embodiments as the coagulation step.

Next, the coagulated fiber is contacted with a hot leaching fluid that is capable of removing residual phosphorous compounds, at a temperature of at least about 60° C. Examples of suitable leaching fluids include hot water, hot liquid organic solvents and "wet" steam. Hot water is useful to reach acceptable phosphorus levels quickly. However, steam, very hot liquid organic solvents and superheated water under pressure are better to reach very low phosphorus levels.

The temperature of hot water is preferably at least about 75° C., more preferably at least about 80° C. and most preferably at least about 85° C. The temperature of steam is preferably at least about 100° C. and more preferably at least about 110° C. The temperature of hot organic solvents is preferably at least about 75° C., more preferably at least about 100° C., more highly preferably at least about 150° C. and most preferably at least about 200° C.

The maximum temperature of the leaching fluid is not critical to the invention and depends on practical limitations. It should be low enough that the polybenzazole polymer and the leaching fluid do not decompose. Preferably, when the leaching fluid is a liquid, the temperature is low enough that the liquid does not boil. Usually, the temperature is no more than about 350° C., and most commonly no more than about 300° C. (However, steam used for leaching is preferably wet steam, having sufficient relative humidity to effectively leach residual solvent from the fiber. The steam is most preferably "saturated" steam. Ordinarily, saturated steam can not be at temperatures higher than about 100° C. to about 120° C. under atmospheric pressures. Steam at higher temperatures will usually require superatmospheric pressures for the most effective leaching).

Hot organic solvent should be selected so that it remains liquid under reaction conditions. Its boiling point is preferably at least about 100° C., more preferably at least about 150° C. and most preferably at least about 200° C. at about atmospheric pressure. It preferably meets at least one of the following qualities: solubility in water of greater than one weight percent, high polarity, and/or ability to form addition complexes with the residual polymerization solvent. Examples of suitable hot organic solvents include: dimethyl sulfoxide, ethylene glycol, propylene carbonate, glycerol and hexyl alcohol.

The pressure during the leaching step is not critical, unless superheated liquids or superheated steam are used. It may optionally be atmospheric pressure, or above or below. It is preferably at least about ambient pressure. Higher pressures may be desirable in order to wash with a liquid at temperatures above its ordinary boiling point. For instance, it may be desirable to wash with water at temperatures of 100° C., 150° C., 200° C. or more under pressures sufficient to keep the water in a liquid state.

The hot leaching fluid may be applied in a single zone or in multiple zones. When it is a liquid it may be applied in an ordinary manner, such as spraying or immersing in baths. When it is steam it may be applied in an ordinary manner, such as by steam jets. Preferably, the hot leaching fluid is applied as the fiber passes between rollers, for instance as described in Guertin, U.S. Pat. No. 5,034,250 (Jul. 23, 1991), which is incorporated herein by reference.

The fiber is preferably under tension during at least part of the washing process. More preferably, tension is also applied throughout the coagulation and leaching process, particularly when the fluid temperature is very high. The tension is preferably sufficient to prevent the fiber from shrinking or relaxing.

The residence time in contact with the hot leaching fluid is preferably no more than about 5 minutes, more preferably no more than about 3 minutes, more highly preferably no more than about 2 minutes and most preferably no more than about 1 minute. The total residence time for coagulation, washing (if done) and leaching is preferably no more than about 5 minutes, more preferably no more than about 3 minutes, more highly preferably no more than about 2 minutes and most preferably no more than about 1 minute.

The coagulation and leaching process is preferably run in a continuous fashion with a line speed of at least about 50 m/min. The line speed is highly preferably at least about 100 m/min., more preferably at least about 200 m./min. and most preferably at least about 400 m./min.

The leached fiber contains high quantities of water, frequently more than 50 weight percent. After the process is completed, the fiber may optionally be dried and heat-treated according to known methods, such as those described in Wolfe, U.S. Pat. No. 4,533,693 (Aug. 5, 1985); Chenevey, U.S. Pat. No. 4,554,119 (Nov. 19, 1985); and Uy, Statutory Invention Registration T105,604 (Jul. 2, 1985), which are incorporated herein by reference. For example, it may be dried in a vacuum or circulating oven, preferably under sufficient tension to prevent shrinkage. The fiber may optionally be washed with a basic solution, such as dilute alkali metal hydroxide, before it is dried.

The residual phosphorus content of the fiber varies depending upon the time and the process conditions. For a shorter leaching process, the residual phosphorus content is preferably no more than about 2500 ppm, more preferably no more than about 1500 ppm, more highly preferably no more than about 1000 ppm and most preferably no more than about 500 ppm. For a somewhat longer process, it is preferably no more than about 200 ppm, more preferably no more than about 150 ppm, more highly preferably no more than about 100 ppm and most preferably no more than about 50 ppm. (Residual phosphorus measurements are based upon the weight of the fiber after it has been substantially dried. Phosphorus can be measured using X-ray fluorescence techniques described in E. P. Bertin, *Principles and Practice of X-Ray Spectrometric Analysis-Second Ed.* (Plenum Press 1984), which is incorporated herein by reference. Suitable equipment is commercially available under the trade name KEVEX 770 XRF and from Philips Electronic Instruments.

The diameter of individual filaments within the finished fiber is preferably no more than about 17 μm, more preferably no more than about 15 μm, and most preferably no more than about 12 μm, on average. Its denier is preferably no more than about 3.5 dpf(denier-per-filament), highly preferably no more than about 3.2 dpf, more preferably no more than about 2.5 dpf, and most preferably no more than about 1.6 dpf. Denier, a common measure of fiber thickness, is the weight in grams of 9000 meters of fiber. Diameters of 10 μm or 8 μm or less can be reached. The minimum filament diameter and denier is limited by practical considerations. Each filament usually has an average diameter of at least about 3 μm and an average denier of at least about 0.1 dpf. The fibers can be used in ropes, cables, fiber-reinforced composites and cut-resistant clothing.

The invention is further illustrated by the following illustrative examples:

ILLUSTRATIVE EXAMPLES

The following examples are for illustrative purposes only, and should not be taken as limiting the scope of either the specification or the claims. Unless otherwise stated, all parts and percentages are by weight. (PPM=parts per million by weight)

Residual phosphorus is measured using X-ray fluoresence. Measurements were performed on a Philips PW1404/DY685 sequential spectrometer with a scandium X-ray tubes. The fiber samples were pressed into a pellet for analysis.

Example 1

Hot Water Leaching

A dope contains about 14 weight percent cispolybenzoxazole polymer (having an intrinsic viscosity of 30–34 in methanesulfonic acid at 25° C.) dissolved in polyphosphoric acid. The dope is spun at 160° C.–170° C. through multiple hole spinnerets under conditions suitable to provide fiber with an average diameter of about 11.5 μm. The spinnerets have holes ranging from 160 to 203 μm in diameter. The air gap is about 30 to 40 cm in length and contains nitrogen at 60° C. flowing at 4 cc/min. The spin-draw ratio is about 20 to 45. (Usually, factors such as spinneret hole size, air gap conditions and spin-draw ratio do not have any noticeable effect on coagulation, washing and leaching, as long as the fiber diameter remains consistent. All conditions in the present invention are varied to provide a fiber with a consistent diameter of about 11.5 μm).

The spun and drawn filaments are immersed for about 0.5 to 1 second in a coagulation bath that contains about 20 percent phosphoric acid at about room temperature. The coagulated fibers are collected into a single continuous filament tow. The tow is leached for 10 to 300 seconds in water at about 100° C., as shown in Table 1. The fiber is dried, and has an average diameter of about 11.5 μm. The residual phosphorus in the fiber is measured and set out in Table 1.

TABLE 1

| Wash Time (sec) | Residual Phosphorus (ppm) | Wash Time (sec) | Residual Phosphorus (ppm) |
|---|---|---|---|
| 10 | 7500 | 87 | 2400 |
| 17 | 3100 | 97 | 2300 |
| 27 | 2800 | 107 | 2300 |
| 37 | 2600 | 117 | 2250 |
| 47 | 2400 | 127 | 2200 |
| 57 | 2450 | 180 | 2100 |
| 67 | 2500 | 300 | 1900 |
| 77 | 2450 | | |

What is claimed is:

1. A process to coagulate and wash a polybenzazole dope fiber, which contains polybenzazole polymer and polyphosphoric acid, comprising the steps of:

(1) contacting the dope fiber with an acidic liquid coagulant, (2) optionally contacting the fiber with a second liquid having a pH higher than the acidic liquid coagulant, and (3) contacting the fiber with a hot leaching fluid, that is capable of removing residual phosphorous compounds, at a temperature of at least about 60° C., for a combined residence time in steps (1), (2) and (3) of no more than about 10 minutes, wherein the surface of the fiber is not allowed to dry prior to step (3) whereby a polybenzazole fiber containing no more than about 5000 ppm phosphorus is formed.

2. The process of claim 1 wherein the acidic liquid coagulant is an aqueous acid solution.

3. The process of claim 2 wherein the acidic liquid coagulant contains from about 10 to about 50 weight percent acid.

4. The process of claim 3 wherein the acid in the coagulant is phosphoric acid.

5. The process of claim 1 wherein the leaching fluid contains water.

6. The process of claim 5 wherein the leaching fluid has a temperature of at least about 75° C.

7. The process of claim 5 wherein the leaching fluid has a temperature of at least about 85° C.

8. The process of claim 1 wherein the leaching fluid is a hot organic solvent.

9. The process of claim 8 wherein the hot organic solvent has a temperature of at least about 100° C.

10. The process of claim 8 wherein the hot organic solvent has a temperature of at least about 150° C.

11. The process of claim 1 wherein the leaching fluid is steam.

12. The process of claim 1 wherein the total residence time in steps (1), (2) and (3) is no more than about 5 minutes.

13. The process of claim 1 wherein the total residence time in steps (1), (2) and (3) is no more than about 3 minutes.

14. The process of claim 1 wherein the residual phosphorus is no more than about 1000 ppm.

15. A process to coagulate and wash a polybenzazole dope fiber, that contains polybenzazole polymer and polyphosphoric acid, comprising the steps of:

(1) contacting the dope fiber with an aqueous solution containing 10 to 50 weight percent acid, (2) optionally contacting the shaped article with a second liquid having a pH higher than the acidic liquid coagulant, and (3) contacting the shaped article with steam, water at a temperature of at least about 75° C., or an organic solvent that is capable of removing residual phosphorous compounds at a temperature of at least about 75° C., for a combined residence time in steps (1), (2) and (3) of no more than about 5 minutes, whereby a polybenzazole fiber containing no more than about 2500 ppm phosphorus is formed.

16. The process of claim 15 wherein the polybenzazole polymer is lyotropic liquid crystalline polybenzoxazole or polybenzothiazole and the dope is liquid crystalline.

17. The process of claim 16 wherein the acid in the coagulant is phosphoric acid.

* * * * *